United States Patent [19]

Villa et al.

[11] Patent Number: 4,881,391

[45] Date of Patent: Nov. 21, 1989

[54] MOVABLE COVER DEVICE FOR AN AUTOMOBILE LOCK

[75] Inventors: Ezio Villa, Arese; Giuseppe Biazzi, Uboldo, both of Italy

[73] Assignee: Alfa Lancia Industriale S.p.A., Arese, Italy

[21] Appl. No.: 211,560

[22] Filed: Jun. 27, 1988

[30] Foreign Application Priority Data

Jul. 16, 1987 [IT] Italy ..... 22026/87[U]

[51] Int. Cl.[4] ..... E05B 17/18

[52] U.S. Cl. ..... 70/455; 70/423; 70/427

[58] Field of Search ..... 70/455, 423, 427

[56] References Cited

U.S. PATENT DOCUMENTS

| | | | |
|---|---|---|---|
| 1,619,972 | 3/1927 | Waters | 70/455 |
| 2,213,814 | 9/1940 | Jacobi | 70/455 |
| 2,343,605 | 3/1944 | Wise | 70/455 |
| 2,388,228 | 10/1945 | Johnstone | 70/455 |
| 2,400,229 | 5/1946 | Freeman | 70/455 |
| 2,562,038 | 7/1951 | Jacobi | 70/455 |
| 3,564,744 | 2/1971 | Shook | 70/455 X |
| 3,564,880 | 2/1971 | Kwasiborski | 70/455 X |
| 3,898,824 | 8/1975 | Borlinghaus | 70/455 |
| 3,930,391 | 1/1976 | Borlinghaus | 70/455 |
| 4,073,165 | 2/1978 | Grundstrom | 70/455 X |
| 4,192,161 | 3/1980 | Borlinghaus | 70/455 |
| 4,586,355 | 5/1986 | Lee et al. | 70/455 |
| 4,597,274 | 7/1986 | Coscia et al. | 70/455 |
| 4,674,308 | 6/1987 | Peters | 70/455 |
| 4,709,567 | 12/1987 | Appelbaum | 70/455 |
| 4,723,428 | 2/1988 | Yamaguchi | 70/455 |
| 4,773,242 | 9/1988 | Smith | 70/427 X |

*Primary Examiner*—Gary L. Smith
*Assistant Examiner*—Suzanne L. Dino
*Attorney, Agent, or Firm*—Charles E. Brown; Charles A. Brown

[57] ABSTRACT

A movable cover device for an automobile lock, comprising a plate supporting the lock operating actuator and fixed to a wall of an automobile compartment, and a cover pivoted on the plate, the device having in the cover an area substantially equal to that of the plate and is provided with a pivot substantially orthogonal to its wall and rotatably supported by a bush which is rigid with the plate and is also orthogonal to its wall, so that the walls of the plate and of the cover are in contact, at least when they are completely superposed.

1 Claim, 2 Drawing Sheets

MOVABLE COVER DEVICE FOR AN AUTOMOBILE LOCK

This invention relates to a movable cover device for an automobile lock, and particularly for the actuator for the lock of an compartment lid, such as the luggage compartment or boot lid. In automobiles, the actuator for opening and closing a lock, such as the boot lock, can be operated either directly by means of a key, or from the interior of the passenger compartment by means of remote controls consisting of electrical push-buttons or levers, and suitable transmissions.

Operating the lock by means of a key is more immediate and therefore more comfortable for the user. Remote control systems offer greater security against tampering, and are more effective from an aesthetic viewpoint because they have no visible parts. The object of the present invention is to provide a device which combines most of the advantages obtainable with the aforesaid types.

The device according to the invention comprises a plate supporting the lock operating actuator and fixed to a wall of an automobile compartment, and a cover pivoted on said plate, the device being characterised in that said cover has an area substantially equal to that of said plate and is provided with a pivot substantially orthogonal to its wall and rotatably supported by a bush which is rigid with said plate and is also orthogonal to its wall, so that the walls of said plate and said cover are in contact, at least when they are completely superposed.

According to a preferred embodiment, a load-reversing wire spring is inserted between the plate and cover, and has its ends pivoted respectively in said plate and in said cover.

Again according to a preferred embodiment, said plate is provided with a partially annular track concentric with said pivot and bush, to act as a guide and limit stop for a peg which is rigid with the cover and engages in said track.

Furthermore, the plate and cover are preferably of substantially similar shape, for example of disc shape.

In this manner a movable cover device for a lock actuator is obtained which can be raised and lowered as required and which enables said actuator to be effectively masked.

Thus normally the cover device hides the actuator from view, so at least partly acting as an obstacle to its unauthorised use while at the same time aesthetically improving the shape of the automobile body, as it results in a smoother and more elegant profile.

Characteristics and advantages of the invention are illustrated hereinafter with reference to the accompanying FIGS. 1 to 4, which show a preferred embodiment of said invention by way of non-limiting example.

Figure 1:
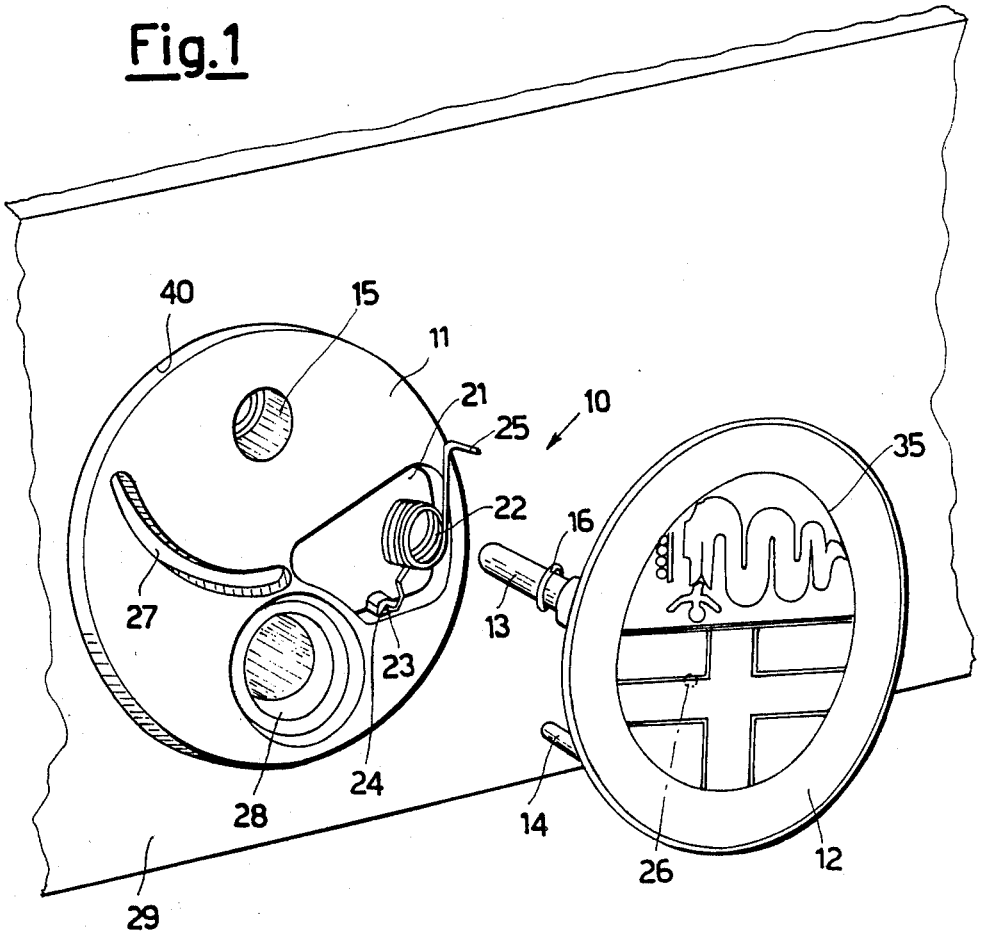
FIG. 1 is an exploded perspective view of the cover device according to the invention.

In FIG. 1 the cover device, indicated overall by 10, is shown partly dismatled and consists of a disc-shaped plate 11 and a disc-shaped cover 12, these therefore being of substantially equal shape and area.

A pivot indicated by 13 and a peg indicated by 14 are rigid with the cover 12, and are both orthogonal to its wall.

Figure 3:
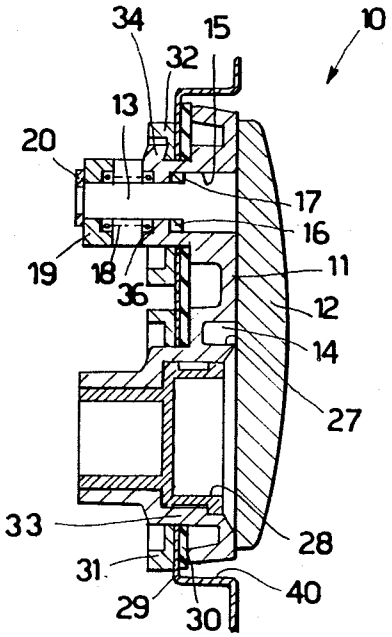
FIG. 3 is a section on the line III—III of FIG. 2 with the device in its closed position.

In the plate 11 there is formed a bush 15 in which the pivot 13 is rotatably supported. As shown in FIG. 3, between the pivot 13 and bush 15 there are interposed an O-ring 16, which rests against a shoulder 17 of said pivot, and a spring 18 which rests on a shoulder 36 of the bush 15 and is retained axially by a washer 19 and a snap ring 20.

A recessed compartment 21 is provided in the plate 11 to house a load-reversing wire spring indicated by 22.

Figure 2:
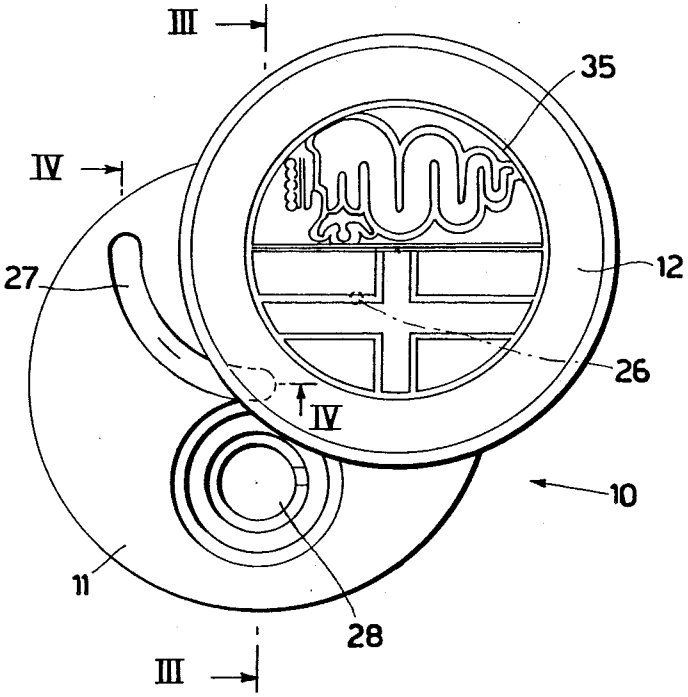
FIG. 2 is a front view of said device.

One end 23 of the spring 22 is pivoted in the plate 11 in correspondence with a hole 24, and the other end 25 of said spring 22 is pivoted in the cover 12 in correspondence with a hole 26, which is shown by dashed and dotted lines in FIGS. 1 and 2. During operation with the device assembled, the end 25 of the spring 22 is inserted in the hole 26, but for ease of representation it is shown in FIG. 1 extracted from the hole 26 and resting against the wall of the compartment 21.

Figure 4:
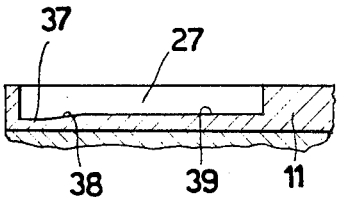
FIG. 4 is a section through a detail on the live IV—IV of FIG. 2.

In the plate 11 there is also provided a partially annular track indicated by 27, which is concentric with the bush 15 and acts, during the relative rotation between the cover 12 and plate 11, as a guide and limit stop for the peg 14 which is inserted in it. Preferably, as shown in FIG. 4, the track 27 has a profiled base formed from a depressed step 37 close to the closure end and situated at a depth equal to the length of the peg 14, a connection ramp 38, and a raised runway 39 situated at a depth less than the length of said peg 14. With this arrangement the plate 11 and cover 12 are in contact when they are completely superposed, whereas they remain slightly separated from each other during relative rotation, and therefore do not slide against each other.

Finally, said plate 11 also comprises a seat 28 in which is mounted the actuator, not shown, for operating the lock of a compartment lid 29 (partly shown) The actuator is preferably operated by a key, also not shown.

Using ring nuts 31 and 32, the plate 11 is fixed, after interposing a rubber gasket 30 visible in FIG. 3, to the sheet metal of the lid 29, for example of the luggage compartment or boot, in a portion 40 thereof which is slightly depressed and recessed, but which nevertheless allows the cover 12 to be easily and completely opened.

The ring nuts 31 and 32 comprise radial recesses, not shown, which enable them to be mounted on the bush 15 and on a bush 33 provided in correspondence with the seat 28, by passing over corresponding radial projections provided on the outside of said bushes, such as that indicated by 34 and visible in FIG. 3.

After rotation, the ring nuts 31 and 32 remain held between the sheet metal 29 and said projections on the bushes 15 and 33. In this particular case, the cover 12 incorporates the trademark emblem, indicated by 35, but it could obviously be painted the same colour as the sheet metal body.

In either case, when the cover 12 covers the plate 11, it hides the lock actuator so providing considerable camouflage which is also aesthetically valid.

The spring 22 exerts a return action on the cover 12, which keeps it securely lowered when in its rest position.

To operate the lock, the cover 12 is raised by rotating it anticlockwise through a path corresponding to an angle of about 90°, so as to completely uncover the seat 28 for the actuator of the lock for the lid 29, as shown in FIG. 2.

In rotating the cover 12, during the first part of its path the return action of the spring 22 has to be overcome, whereas after passing beyond the load reversing position or dead point, in which the ends 23 and 25 of the spring 22 are coplanar with the axis of the pivot 13, said spring exerts on the cover an action in the opening direction, which keeps it raised in its end-of-travel position shown in FIG. 2.

We claim:

1. A movable cover device for an automobile lock, said device comprising a plate supporting a lock operating actuator, means for fixing said plate to a wall of a compartment of an automobile, and a cover being pivotably mounted on said plate, said cover having an area substantially equal to that of said plate, said cover having a wall and a pivot positioned substantially orthogonal to said cover wall, said plate having a wall and a bush for rotatably supporting said pivot, said bush being rigid with said plate wall and positioned substantially orthogonal to said plate wall, said plate wall and said cover wall being in contact when said cover and said plate are completely superposed, a load-reversing wire spring being positioned between said plate and said cover, and said load-reversing wire spring having a pair of ends, one of said spring ends being pivotably mounted in said plate and the other of said spring ends being pivotably mounted in said cover, said track having a profiled base formed from a depressed step close to its closure end and being situated at a depth equal to the length of said peg, a connection ramp, and a raised runway being situated at a depth less than the length of said peg.

* * * * *